US006453133B1

(12) United States Patent
Osari et al.

(10) Patent No.: US 6,453,133 B1
(45) Date of Patent: Sep. 17, 2002

(54) IMAGE PROCESS APPARATUS WITH AUTOMATIC SETTING OF PROOF PRINTING MODE

(75) Inventors: Yoshihito Osari; Masahiro Serizawa; Rieko Akiba, all of Shizuoka-ken; Shunsaku Kondo, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/636,705

(22) Filed: Aug. 11, 2000

(30) Foreign Application Priority Data

Aug. 17, 1999 (JP) ..... 11-230941

(51) Int. Cl.[7] ..... G03G 15/00
(52) U.S. Cl. ..... 399/82; 399/403; 399/407
(58) Field of Search ..... 399/82, 83, 403, 399/407

(56) References Cited

U.S. PATENT DOCUMENTS

| | | | | |
|---|---|---|---|---|
| 4,855,786 A | | 8/1989 | Ohira et al. | 355/218 |
| 5,069,124 A | | 12/1991 | Schneider | 101/142 |
| 5,109,252 A | * | 4/1992 | Schott | 399/83 |
| 5,349,377 A | * | 9/1994 | Gilliland et al. | 399/181 X |
| 5,504,696 A | | 4/1996 | Debes | 346/571.01 |
| 5,555,099 A | * | 9/1996 | Telle | 399/403 X |
| 5,655,759 A | * | 8/1997 | Perkins et al. | 399/363 X |
| 6,041,200 A | * | 3/2000 | Glass et al. | 399/82 |

FOREIGN PATENT DOCUMENTS

| | | | |
|---|---|---|---|
| EP | 0849077 A1 | | 6/1998 |
| JP | 9-204279 | * | 8/1997 |
| JP | 10-207301 | * | 8/1998 |
| JP | 10-250928 | * | 9/1998 |
| JP | 2000-122479 | * | 4/2000 |

OTHER PUBLICATIONS

Kojima Hiroaki, "Image Forming Device", Patent Abstracts of Japan, European Patent Office Mar. 26, 1993, Abstract.
Takaoka Iwane, "Copying Device", Patent Abstracts of Japan, European Patent Office, Jun. 1, 1988, Abstract.

* cited by examiner

*Primary Examiner*—Fred L. Braun
(74) *Attorney, Agent, or Firm*—Fitzpatrick, Cella, Harper & Scinto

(57) ABSTRACT

An image forming apparatus which forms an image on a sheet by an image forming device based on image information, and which discharges the sheet on which the image is formed. The apparatus has a proof printing mode in which, when, in the process of forming an image on sheets to form a plurality of copies of the image, the sheets having the image formed thereon to form a first copy is discharged, the image formation is temporarily stopped by an image formation stopping device. The apparatus also has a mode controller for automatically setting the proof printing mode when execution of a predetermined process mode is selected.

16 Claims, 13 Drawing Sheets

IMAGE PROCESS APPARATUS WITH AUTOMATIC SETTING OF PROOF PRINTING MODE

BACKGROUND OF THE INVENTION

1. Field of the Invention

The present invention relates to an image forming apparatus, such as a copying machine or a printer, having a proof-printing mode in which, when, in the process of forming images on sheets to form a plurality of copies of the images, the first copy is formed and discharged, the image formation on subsequent sheets is temporarily stopped to enable a user to check the state of image formation of the first copy, and the image formation is thereafter performed again.

2. Related Background Art

A type of conventional image forming apparatus is known which has an image storage unit such as a hard disk, i.e., an image server, and which is capable of forming a plurality of copies of original images after inputting each of the original images one time without repeating the image inputting operation a number of times corresponding to the number of sheets for the copies.

This type of image forming apparatus has an image server, and a page memory in which images stored in the image server and processed and modified in a synthesis manner are developed, and is therefore capable of having much more image forming modes than the image forming modes provided by, for example, an analog copying machine.

The provision of many image forming modes provided in this manner means that users can use various output patterns such that it is sometimes difficult for the users to suppose the finished state of batches of outputs. Image forming apparatuses have been increased which have, as a means helpful to users in such a situation, a proof printing function such that, in the case where a plurality of copies are output, the finished state of the first copy is checked when it is output, and the other copies are thereafter output if the qualities of the first copy are satisfactory.

On the other hand, systems formed by combining a sheet inserting device and an image forming apparatus have been proposed. For example, in such systems designed according user's needs, a color page can be inserted in a document formed from black-and-white originals to form a booklet.

If such a sheet inserting device is used, various sheets (preprint sheets) previously printed and various materials can be inserted into one document. Thus, varieties of documents, which can be treated by image forming apparatuses, have been increased and realized as documents more favorable for users.

However, in a situation where such a sheet inserting device is used to combine sheets previously printed (preprint sheets, insert sheets) and sheets on which images are to be formed thereafter into one batch of sheets, it is difficult for a user to make a determination as to the orientation of the preprint sheets, etc., depending upon a rotation mode in which the orientation of a read image of an original is rotated so as to coincide with the orientation of the original, or a stapling mode in which a batch of sheets can be stapled at any position. In such a situation, the burden on the user in using the image forming apparatus may be considerably large.

SUMMARY OF THE INVENTION

In view of the above-described circumstances, an object of the present invention is to provide an image forming apparatus which enables a user to easily check the finished state of a proof print by automatically setting a proof printing mode in the case where a predetermined process mode (print job), e.g., a sheet insertion mode using a sheet inserting device is executed, and which is therefore capable of preventing occurrence of a large amount of misprints resulting from omission of setting the proof printing mode.

To achieve this object, the present invention provides an image forming apparatus which forms an image on a sheet by image forming means based on image information, and which discharges the sheet on which the image is formed, the apparatus comprising a proof printing mode in which, when, in the process of forming the image, discharge of the sheets having the image formed thereon to form a first copy is completed, the image formation is temporarily stopped by image formation stop means, and mode control means for automatically setting the proof printing mode when execution of a predetermined process mode is selected.

BRIEF DESCRIPTION OF THE DRAWINGS

FIG. 9A shows a state in which a cover sheet keypad for selecting attachment of a cover sheet is displayed;

FIG. 9B shows a state in which a keypad for setting a method of inserting a cover sheet is displayed;

FIG. 10A shows a state in which sheet selecting keypads are displayed;

FIG. 10B shows a state in which staple position selecting keypads are displayed;

FIG. 11A shows a screen on the display panel showing a state after setting the proof mode and before a start of printing;

FIG. 11B shows a screen on the display panel showing a state in which the printing operation is stopped to enable a user to check the result of one copy when the copy is output, and to select whether to continue printing;

DESCRIPTION OF THE PREFERRED EMBODIMENTS

Embodiments of the present invention will be described with reference to the accompanying drawings.

Figure 1:
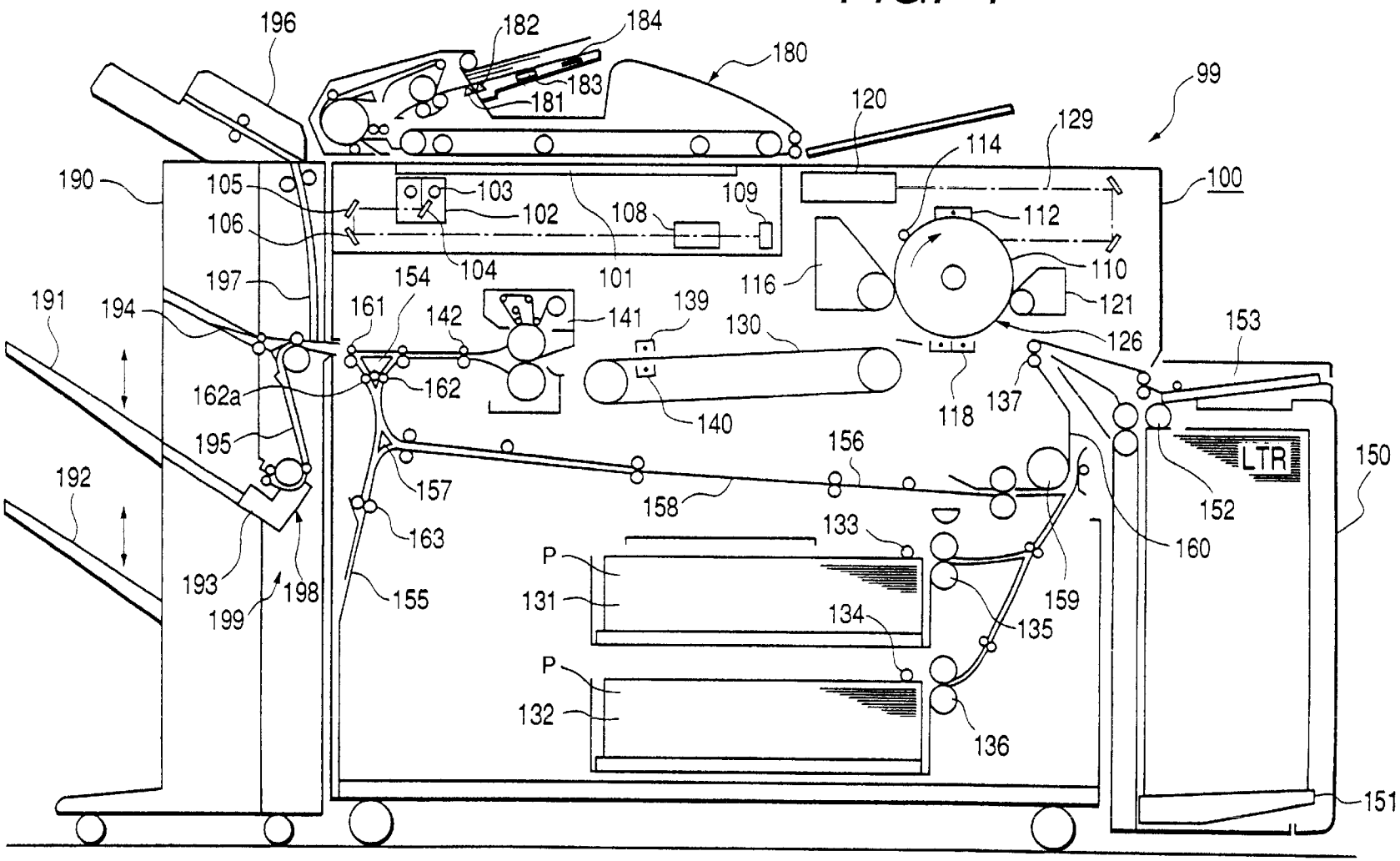
FIG. 1 is a schematic front cross-sectional view of an image forming apparatus in accordance with the present invention.

Referring to FIG. 1, an automatic original feeding device 180 is provided on a main body 100 of an image forming apparatus 99.

A platen glass plate used as an original stock table is indicated by reference numeral 101 in FIG. 1. A scanner 102 is constituted by an original illumination lamp 103, a scanning mirror 104, etc. The scanner 102 is driven by a motor (not shown) to travel, for its scanning operation, between two positions along a predetermined direction. Reflected light from an original travels via scanning mirrors 104 to 106 and passes through a lens 108 to image the original on a charge-coupled device (CCD) sensor 109. An exposure controlling portion 120 is constituted by a laser, a polygon scanner, etc., and irradiates a photosensitive drum 110 with laser beam 129, which is modulated in accordance with an image signal which is obtained as an electrical signal by the image sensor portion and is processed by predetermined image processing described below. The photosensitive drum 110, and components provided around the photosensitive drum 110, i.e., a primary charger 112, a developing device 121, a transfer charger 118, a cleaning device 116, and a pre-exposure lamp 114, etc., constitute an image forming portion 126.

In the image forming portion 126, the photosensitive drum 110 is rotated by a motor (not shown) in a direction indicated by the arrow in FIG. 1. The photosensitive drum 110 is charged to desired potentials by the primary charger 112 and is thereafter irradiated with laser beam 129 from the exposure controlling portion 120 to form an electrostatic latent image. The electrostatic latent image formed on the photosensitive drum 110 is developed by the developing device 121 to be changed into a toner image formed as a visible image.

On the other hand, a sheet P picked up from an upper cassette 131 or a lower cassette 132 by a pickup roller 133 or 134 is fed into the main body by a feed roller 135 or 136 and fed onto a transfer belt 130 by registration rollers 137, and the toner image formed as a visible image is then transferred onto the sheet by the transfer charger 118.

Sheets usable in the image forming apparatus are, for example, ordinary paper sheets, thin resin sheets used as a substitute for ordinary paper, postcards, cardboard, sealed letters, plastic sheets, etc.

After transfer, toner remaining on the photosensitive drum is removed by the cleaning device 116, and residual charge is eliminated by the pre-exposure lamp 114. The sheet after transfer is separated from the transfer belt 130 to be fed to a fixing device 141, with the toner image recharged by anti-fixation chargers 139 and 140. The sheet separated from the transfer belt 130 is pressed and heated by the fixing device 141 to fix the image, and is thereafter discharged out of the main body 100 by a discharge roller 142.

A deck 150 which can contain, for example, about 4000 sheets is provided on the right-hand side of the main body 100, as viewed in FIG. 1. A lifter 151 of the deck 150 lifts according to the amount of sheets so that the uppermost sheet is always in contact with a pickup roller 152. A multi-manual feed tray 153 which can contain about 100 sheets is provided on the deck 150.

Further, a discharge flapper 154 provided in a left end section of the main body 100, as viewed in FIG. 1, is adapted to change the sheet path downstream of the discharge roller 142 between the two-sided recording or multi-recording side and the discharge side. The path through which the sheet is fed forward from the discharge roller 142 is changed for two-sided recording or multi-recording by the discharge flapper 154.

Along a lower transport path 158, a sheet fed forward from the discharge roller 142 and reversed by being transferred on a surface reverse path 155 is guided to a re-feed tray 156. A multi-path flapper 157 for changing two-sided recording and multi-recording routes can be swayed leftward to guide the sheet directly to the lower transport path 158 without routing via the surface reverse path 155.

A roller 159 is a feed roller for feeding sheets to the photosensitive drum 110 along a path 160. A roller 161 is a discharge roller which is disposed in the vicinity of the discharge flapper 154, and which discharges a sheet whose course has been changed by the discharge flapper 154 to the discharge side.

When two-sided recording (two-sided copying) or multi-recording (multi-copying) is performed, the discharge flapper 154 is moved upward to store sheets used for copying on the re-feed tray 156 via the transport paths 155 and 158. At this time, in the case of two-sided recording, the multi-path flapper 157 is swayed rightward or, in the case of multi-recording, the multi-path flapper 157 is swayed leftward. The feed roller 159 feeds sheets stored on the re-feed tray 156 to the registration rollers 137 in the main body via the path 160, the sheets being fed one by one in the order from the lowermost one to the uppermost one.

When a sheet is discharged out of the main body after being reversed, the discharge flapper 154 is moved upward, the flapper 157 is swayed rightward, and the sheet used for copying is transported to the surface reverse path 155. After the trailing end of the sheet has passed a first feed roller 162, the sheet is transported to the second feed roller 162*a* side by a reverse roller 163 and is discharged out of the machine with its image bearing surface facing downward.

A discharge sheet treating device designated by the reference numeral 190 jogs and binds sheets discharged from the image forming apparatus 99. The discharge sheet treating device includes a punching device 198 for cutting holes in a batch of sheets, and a stapler 199 provided as a stitching device for stitching a batch of sheets. If discharge batch treating operations, such as sorting and stapling, are not set in an operating portion 172 described below, sheets are transported along a transport path 194 and are discharged one by one onto a discharge tray 191 without undergoing treatment on a treatment tray 193. If the discharge batch treating operations are set, sheets discharged one by one by being transported along a transport path 195 are stacked and jogged on the treatment tray 193. After discharge of one copy of a set of formed images has been completed, the corresponding batch of sheets are stitched and discharged onto the discharge tray 191 or 192. Basically, a batch of sheets are discharged onto the discharge tray 191 if the discharge batch treating operations are set. However, discharge onto the discharge tray 192 may be performed according to a fully-stacked state or other conditions. The discharge trays 191 and 192 are moved in the vertical direction by a motor (not shown) under control to be moved, before a start of the image forming operation, to a position such as to be used as a treatment tray.

A sheet inserting device designated by the reference numeral 196 is positioned above the discharge sheet treating device 190.

If a setting for performing a sheet inserting operation in a cover sheet mode or the like is made by a user in the operating portion 172 described below, a sheet to be inserted, previously stored in the sheet inserting device 196, is transported along a transport path 197 and transferred onto the transport path 194 or 195 to be discharged through the same discharge opening as sheets discharged from the image forming apparatus 99.

Figure 2:
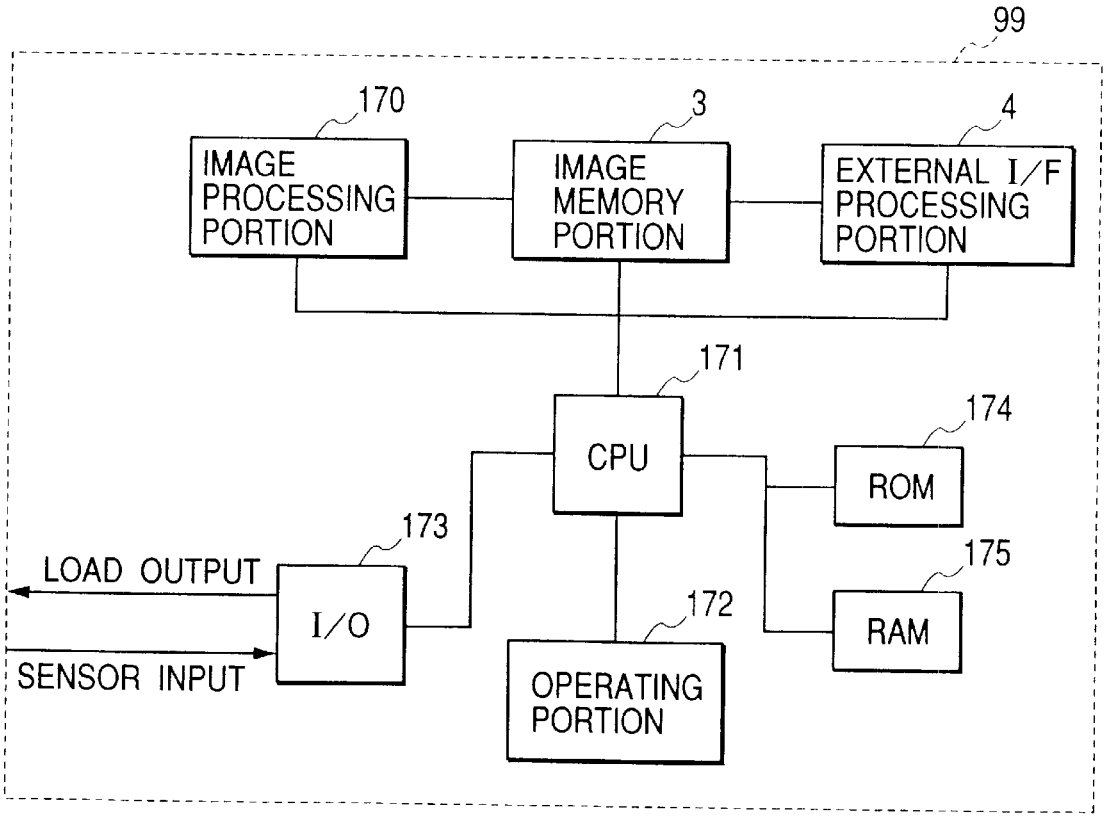
FIG. 2 is a control block diagram of the image forming apparatus shown in FIG. 1.

FIG. 2 is a control block diagram of the image forming apparatus 99. A central processing unit (CPU) 171 performs basic control of the image forming apparatus 99. A read-only memory (ROM) 174 in which control programs are written, a work random access memory (RAM) 175 for enabling processing, an input/output port 173 are connected to the CPU 171 by an address bus and a data bus. The CPU 171 also functions as a mode control means for controlling the operation in various processing modes.

Various loads, such as motors and clutches (not shown), and inputs from sensors (not shown) for detecting sheet positions are connected to the input/output port 173.

The CPU 171 successively performs input/output controls through the input/output port 173 according to the contents of the ROM 174 to execute the image forming operation. The operating portion 172 is connected to the CPU 171. The CPU 171 controls display means and key-in means in the operating portion 172.

When a user inputs an instruction to change the image forming operation mode or the display to the CPU 171 through the key-in means, the CPU 171 displays the state of the image forming apparatus 99 and a screen for operation mode setting by inputting with keypads. An image processing portion 170 for processing an electrical signal obtained by conversion in the image sensor portion 109 and an image memory portion 3 for storing processes images are also connected to the CPU 171.

The image processing portion 170 will be described with reference to FIG. 3.

Figure 3:
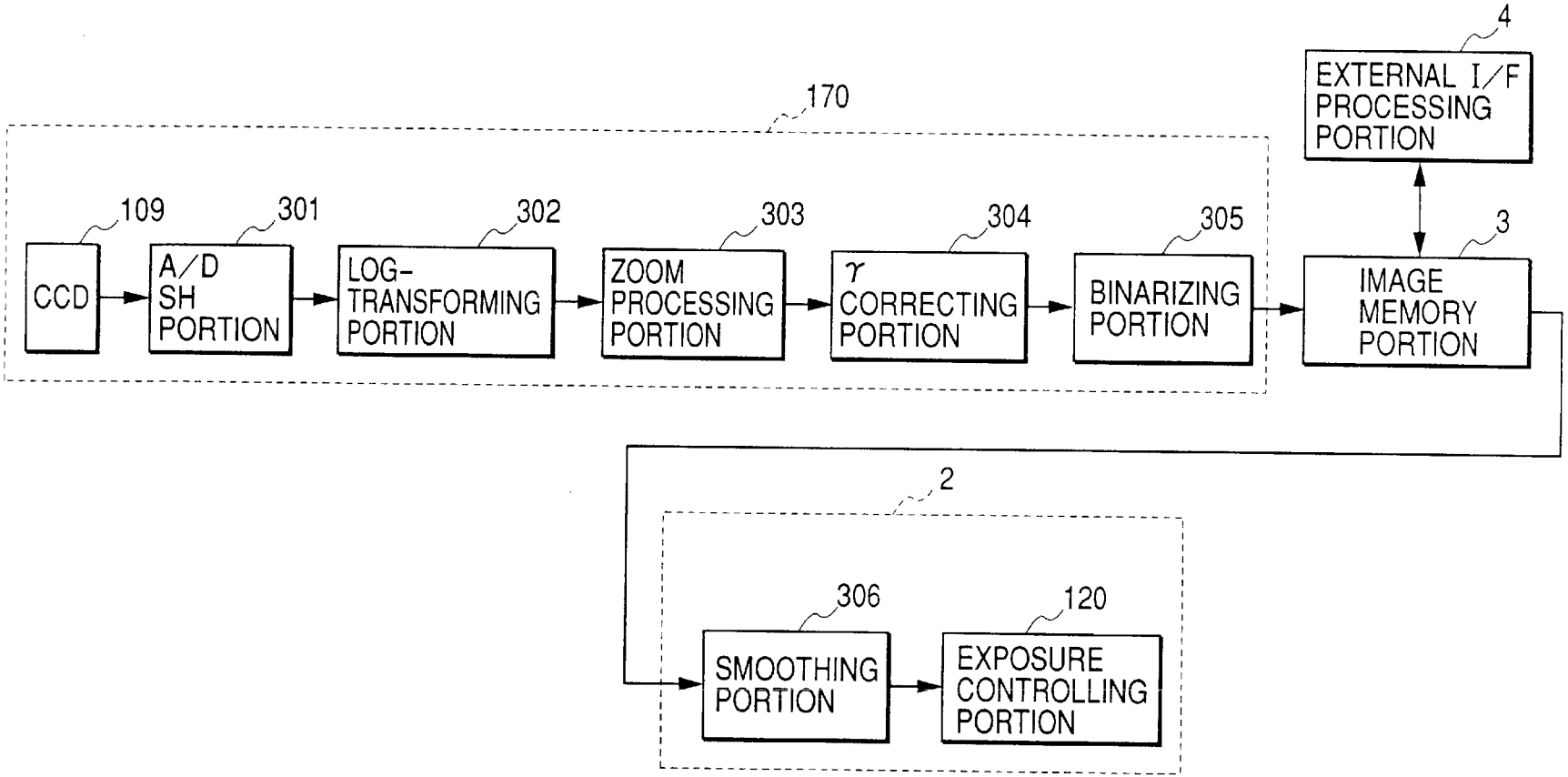
FIG. 3 is a control block diagram of an image processing portion shown in FIG. 2.

FIG. 3 is a block diagram of the image processing portion 170.

An image of an original imaged on the CCD sensor 109 by the lens 108 (see FIG. 1) is input as a brightness data Black and is converted into an analog electrical signal by the CCD sensor 109.

The converted image information is input to an analog signal processing portion (not shown), and sample and hold processing, dark level compensation, etc., of the image information is performed. Then, in an A/D converting portion 301, analog to digital (A/D) conversion of the image information is performed to form a digital signal, which is processed for shading compensation (compensation for variations of the sensor that reads the original and lighting characteristics of the original illumination lamp). The process signal is supplied to a log-transforming portion 302.

In the log-transforming portion 302, a look-up table (LUT) for transforming input brightness data into density data is stored, and the brightness data is transformed into density data by outputting table values corresponding to the input data. Thereafter, zooming of the image to the desired magnification is performed in a zoom processing portion 303, and the data is input to a γ-correcting portion 304.

In the γ-correcting portion 304, when the density data is output, it is transformed by using the LUT and by considering printer characteristics to adjust the output according to density values set in the operating portion 172. The data is then output to a binarizing portion 305.

In the binarizing portion 305, multi-valued density data is binarized so that the density value is "0" or "225". Eight-bit image data is binarized into 1-bit image data formed by "0" or "1", and the amount of image data to be stored in the memory is thereby reduced.

However, if an image is binarized, the number of gradations of the image is reduced from 256 to 2. In general, if image data such as that for a photographic image is binarized, the deterioration of the image is considerable. Therefore, there is a need for pseudo halftone expression using binary data.

In this embodiment, an error diffusion method is used as a method for performing pseudo halftone expression with the binary data. In this method, binarization is performed by setting a density data item "255" when the density value of an image is larger than a threshold value, and a density data item "0" when the density value is equal to or smaller than the threshold value, and the difference between the actual density data and the binarized data of each pixel is distributed as an error signal to surrounding pixels.

Error distribution is performed in such a manner that an error caused by binarization is multiplied by a weighting coefficient in a previously prepared matrix, and the product is added to the values of surrounding pixels. In this manner, an average density value for the entire image is preserved and a pseudo halftone can be expressed from binary data.

The binarized image data is supplied to the image memory portion 3 to store the image. Image data supplied from a computer and input through an external interface (I/F) processing portion 4 is binary image data processed in the external I/F processing portion 4. Therefore, it is directly supplied to the image memory portion 3. The image memory portion 3 includes a high-speed page memory portion 401 and a large-capacity memory (hard disk) 404 capable of storing a plurality of image data groups corresponding to a plurality of pages.

The plurality of image data groups stored in the hard disk are output in the order according to an editing mode designated by the operating portion of the image forming apparatus 99. For example, in the case of sorting, the images of a batch of originals read by the automatic original feeding device 180 are output in order. The temporarily-stored image data of the originals are read out from the hard disk and this reading is repeated a certain number of times to output the image data. In this manner, the same function as that of a sorter having a plurality of bins can be achieved.

The image data output from the image memory portion 3 is supplied to a smoothing portion 306 in a printer portion 2. In the smoothing portion 306, the data is interpolated so that the edge of the binarized image is smoothed, and the interpolated data is output to the exposure controlling portion 120. In the exposure control portion 120, the above-described processing is performed to form the image represented by the image data on a sheet.

Figure 4:
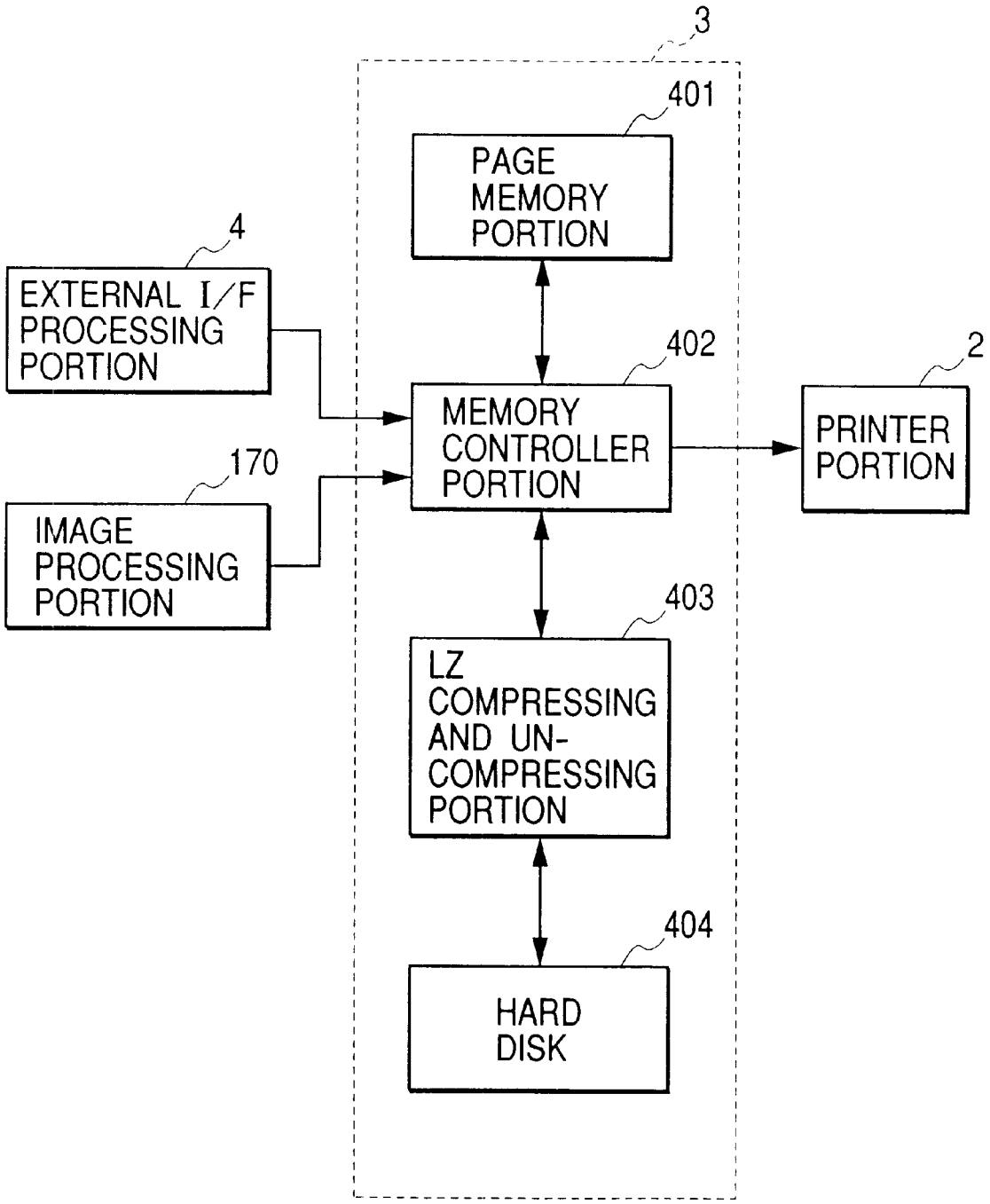
FIG. 4 is a control block diagram of an image memory portion shown in FIG. 2.

The configuration of the image memory portion 3 will next be described with reference to FIG. 4.

In the image memory portion 3, binary images supplied from the external I/F processing portion 4 and the image processing portion 170 are written in the page memory portion 401 comprising a memory such as DRAM through a memory controller portion 402, and reading of the images to the printer portion 2 and input/output accessing to the large-capacity storage unit, i.e., the hard disk 404, are performed.

The memory controller portion 402 generates a DRAM refresh signal for the page memory portion 401, and mediates accesses from the external I/F processing portion 4, the processing portion 170 and the hard disk 404 to the page memory portion 401. Further, the memory controller portion 402 controls page memory 401 writing addresses, page memory 401 reading addresses, the reading direction, etc. The CPU 171 thereby controls the function of laying out a plurality of original images on the page memory portion 401 and outputting the images to the printer portion, the function of cutting out and outputting a portion of an image, and the function of rotating an image.

Figure 5:
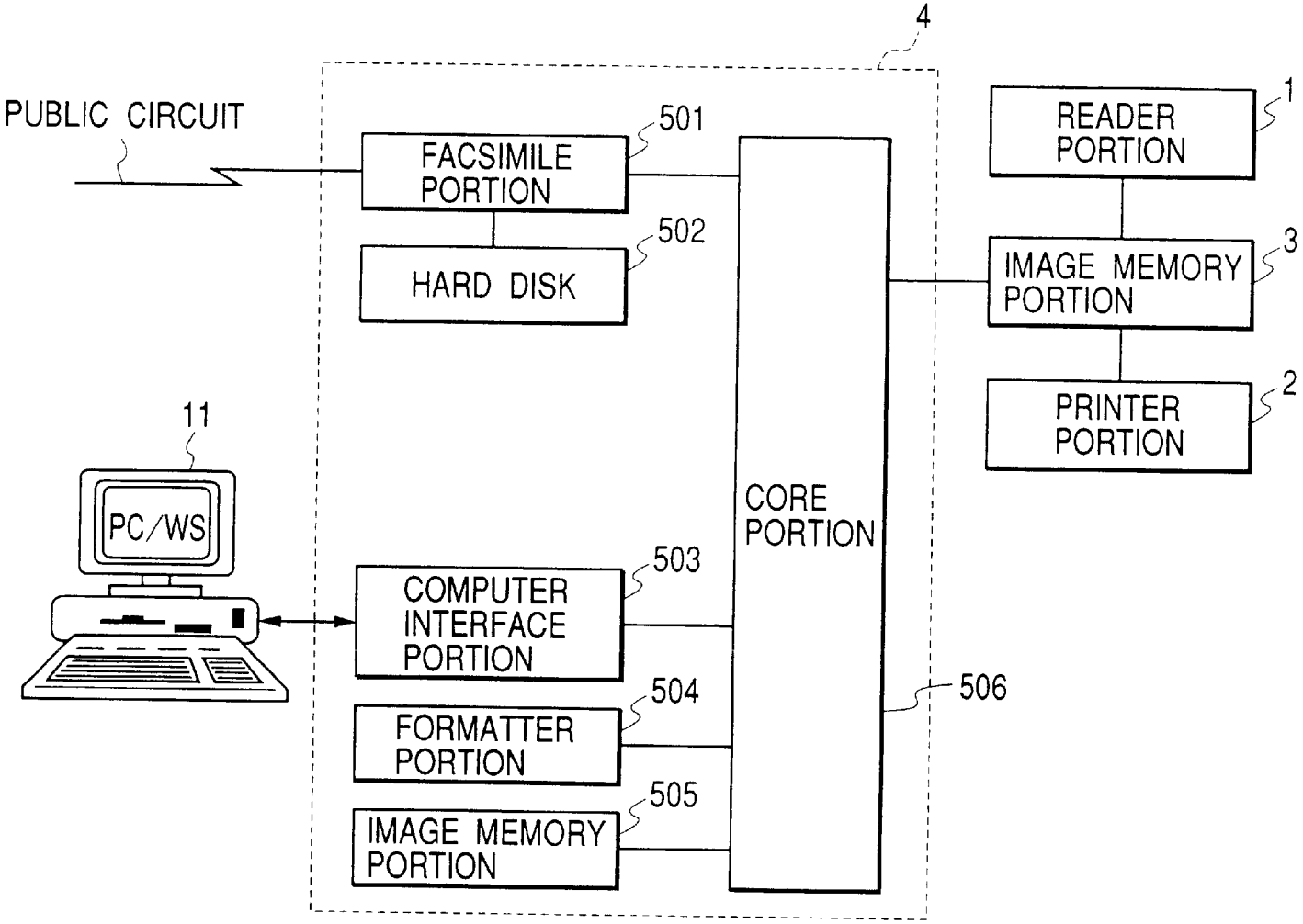
FIG. 5 is a control block diagram of an external I/F processing portion.

The configuration of the external I/F processing portion 4 will be described with reference to FIG. 5.

As mentioned above, the external I/F processing portion 4 takes in binary data from a reader portion 1 through the image memory portion 3, and outputs binary image data through the memory portion 3 to the printer portion 2 to form the image. The external I/F processing portion 4 includes a core portion 506, a facsimile portion 501, a hard disk 502 for storing communication image data of the facsimile portion 501, a computer interface portion 503 for connection to an external computer 11, a formatter portion 504, an image memory portion 505, and the like.

The facsimile portion 501 is connected to a public circuit via a modem (not shown), receives facsimile communication data from the public line, and transmits facsimile communication data to the public line. In the facsimile portion 501, processing based on storing facsimile images in the hard disk 502 is performed for facsimile functions of transmitting facsimile data at a designated time, transmitting image data in response to a request for information with an assigned password from the other end of a line, etc.

Therefore, once images are transmitted from the reader portion 1 to the facsimile portion 501 and the facsimile hard disk 502 through the image memory portion 3, facsimile transmission can be performed without using the reader portion 1 and the image memory portion 3.

The computer interface portion 503 is arranged to perform data communication with external computers, and has a local area network (LAN), a serial I/F, a small computer system interface (SCSI), a Centronics I/F for inputting printer data, etc.

Through this I/F, the external I/F processing portion 4 informs an external computer with the states of the printer portion and the reader portion, transmits an image read by the reader portion 1 to an external computer by an instruction from a computer, receives printing image data from an external computer, and performs other operations. Printing data supplied from an external computer through the computer interface portion 503 is a kind of data described in accordance with a special printer code. Therefore, the formatter portion 504 converts such data into a raster image data for image forming in the printer portion 2 through the image memory portion 3.

The formatter portion 504 develops raster image data in the image memory portion 505. The image memory portion 505 is thus used as a memory in which raster image data is developed by the formatter portion 504, and is also used in such a manner that, when an image from the reader portion 1 is sent to an external computer through the computer interface portion 503 (an image scanner function), image data supplied from the image memory portion 3 is temporarily developed in the image memory portion 505 and is then converted into a data format for the external computer, and the converted data is sent out through the computer interface portion 503.

The core portion 506 controls and manages data transmission among the facsimile portion 501, the computer interface portion 503, the formatter portion 504, the image memory portion 505, and the image memory portion 3. Thus, even if the external I/F processing portion 4 has a plurality of image output portions, and even if there is only one image transmission path to the image memory portion 3, image outputs can be made by exclusion control and priority control under the management of the core portion 506.

The operating portion 172 for setting copying operations and various processing modes of the image forming apparatus shown in FIG. 1 will next be described with reference to FIG. 6.

Figure 6:
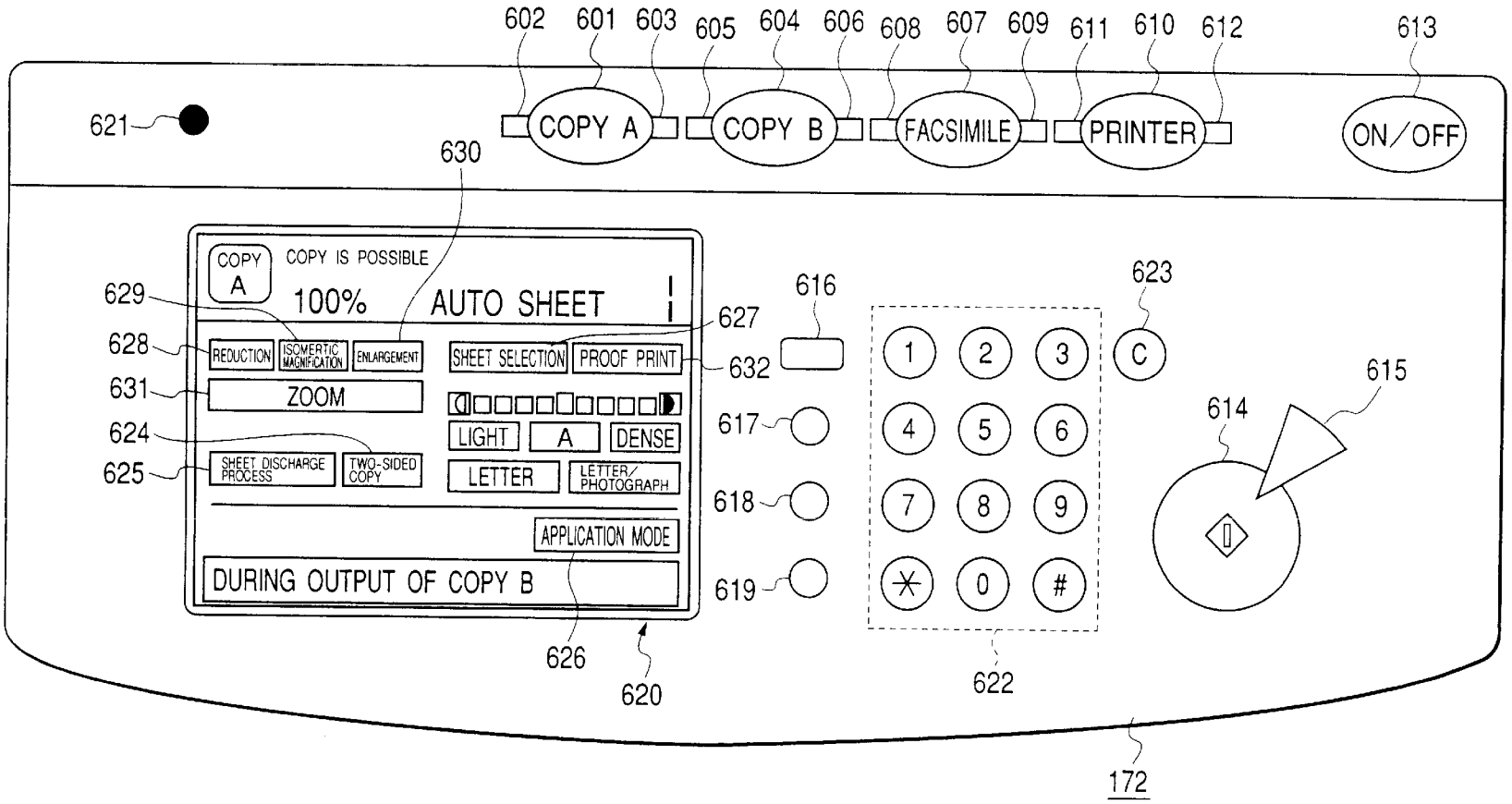
FIG. 6 is a plan view of an operating portion of the image forming apparatus shown in FIG. 1.

A power lamp designated by the reference numeral 621 in FIG. 6 indicates the on state of a power supply. The power lamp 621 is turned on and off according to the on and off states of the power supply switched by a power switch 613. A numeric keypad 622 is a group of keypads used for inputting numerical values in setting the number of sheets on which images are to be formed, in mode setting, etc. When a facsimile setting screen is displayed on a display panel 620 described below, the numeric keypad 622 is used for inputting a telephone number.

A clear keypad 623 is a keypad for canceling a setting input by the numeric keypad 622. A reset keypad 616 is a keypad for resetting each of the set number of image formation sheets, the operation mode, the mode of selected sheet stacking means, etc., to a predetermined value. A start keypad 614 is operated by being depressed by a user to start the image forming operation. At a center of the start keypad 614, red and green light emitting diodes (LEDs) (not shown) are provided to indicate whether the image forming operation can be started. If the operation cannot be started, the red LED is lighted. If the operation can be started, the green LED is lighted. A stop keypad 615 is a keypad for stopping the copying operation.

A guide keypad 617 is used in such a manner that, after the guide keypad 617 has been depressed, another keypad is depressed to display on the display panel the description of the functions which can be set by the keypad. This guide display is canceled by again depressing the guide keypad 617.

A user setting keypad 618 is depressed by a user to enable settings of the image forming apparatus to be changed. The settings changeable by a user are set with respect to all the functions common to printing and copying. They are, for example, the time before settings are automatically canceled, timer settings, and the setting of a dedicated tray.

Figure 7:
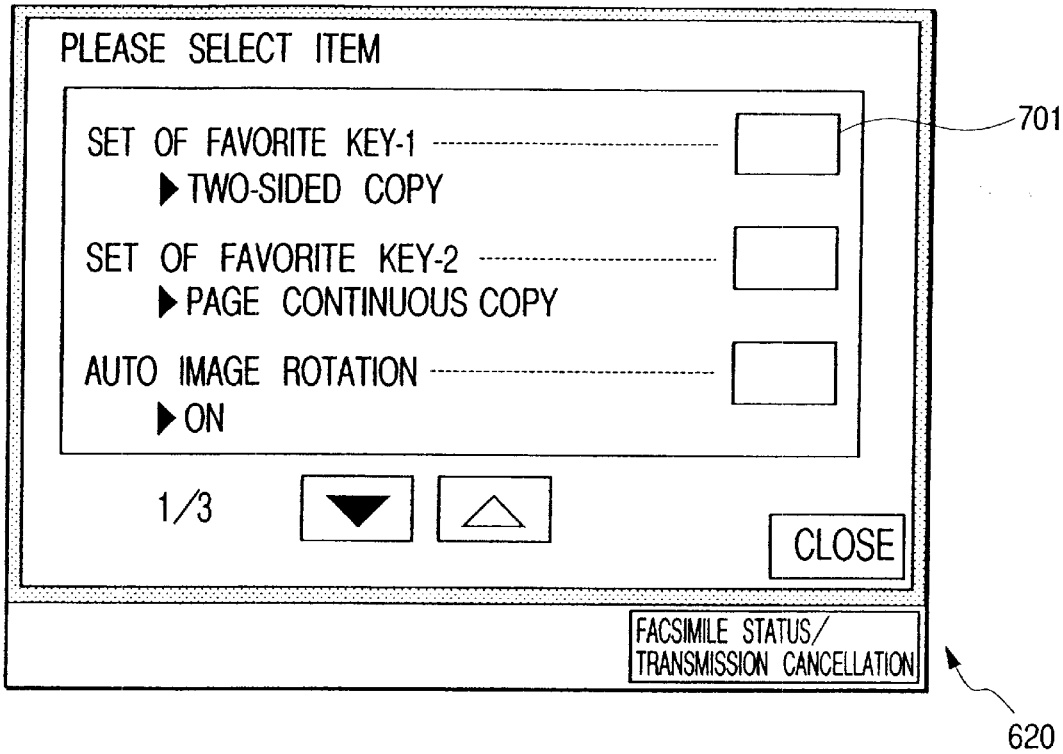
FIG. 7 is a plan view of a display panel on which screen user setting keypads for setting with respect to the entire image forming apparatus are displayed.

FIG. 7 is an example of a screen for setting the whole copying functions. In this example, a screen for on/off setting of an automatic rotation function is used. The automatic rotation function for automatically rotating an image is activated based on use of the image rotating function in the image memory portion 3, if this function setting is made, and if it is determined that the image can be transferred without being trimmed after being rotated from the original size detected by the original size detecting functions of a pair of width size sensors 181 respectively provided on a pair of aligning plates (not shown) for aligning the width of the sheet on the automatic original feeding device 180, and length size detecting sensors 182, 183, and 184 provided on the automatic original feeding device 180, and from the sheet size obtained by size detecting mechanisms in the upper cassette 131 and the lower cassette 132. If it is determined that the image extends beyond one side of the sheet after being rotated, the image rotating processing is stopped. The size and orientation of sheets in the cassettes 131 and 132 are automatically sensed when a selecting keypad 627 (see FIG. 6) for selecting one of the cassettes 131 and 132 as described below is depressed, since the sizes of sheets accommodated in the cassettes are previously determined, and since one of the sizes is selected when a user depresses the selecting keypad 627. This automatic sensing is performed by the CPU 171.

If an automatic cassette selecting function described below is set, and if this automatic rotation function is on, an automatic rotated-size cassette selecting function, which sets a rotated-size cassette as an object of automatic cassette selection if the rotated-size cassette exists, is simultaneously activated along with the automatic cassette selection in the case of ordinary image formation without rotation.

Referring back to FIG. 6, an interrupt keypad 619 is a keypad for enabling copying without using the automatic original feeding device 180 (see FIG. 1). When the interrupt keypad 619 is depressed during the operation of the image forming apparatus, image forming operations other than this copying are stopped and this copying is performed.

The display panel 620 formed of a liquid crystal or the like is arranged so that display contents are changed according to a set mode to facilitate detailed mode settings. A touch sensor is formed in the surface of the display panel.

In FIG. 6, an example of a screen for setting a copying mode is illustrated. Keypads designated by the reference numerals 624 to 632 in FIG. 6 are provided in the display panel 620. When one of these keypads is touched, it is determined that the keypad has been operated, and the corresponding mode is set.

When the selecting keypad 627 (see FIG. 6) for selecting the cassette 131 or 132 is depressed, a display is made on the display panel 620 to indicate the source form which sheets are fed, i.e., one of the cassettes 131 and 132, the deck 150, and the manual feed tray 153, or to indicate whether an automatic cassette selecting mechanism is set which automatically selects one of the cassettes according to the original size, the magnification, the copying mode, etc.

Keypads for setting the copying magnification in the copying operation are designated by the reference numerals 628 and 631 in FIG. 6.

When an application mode setting keypad 626 is depressed, a screen is displayed on the display panel to enable setting of application function modes, such as a multiple operation mode, a reduction layout mode, and a cover sheet/slip sheet mode. For example, keypads for setting various application modes shown in FIG. 8 are displayed to enable application mode setting.

Figure 8:
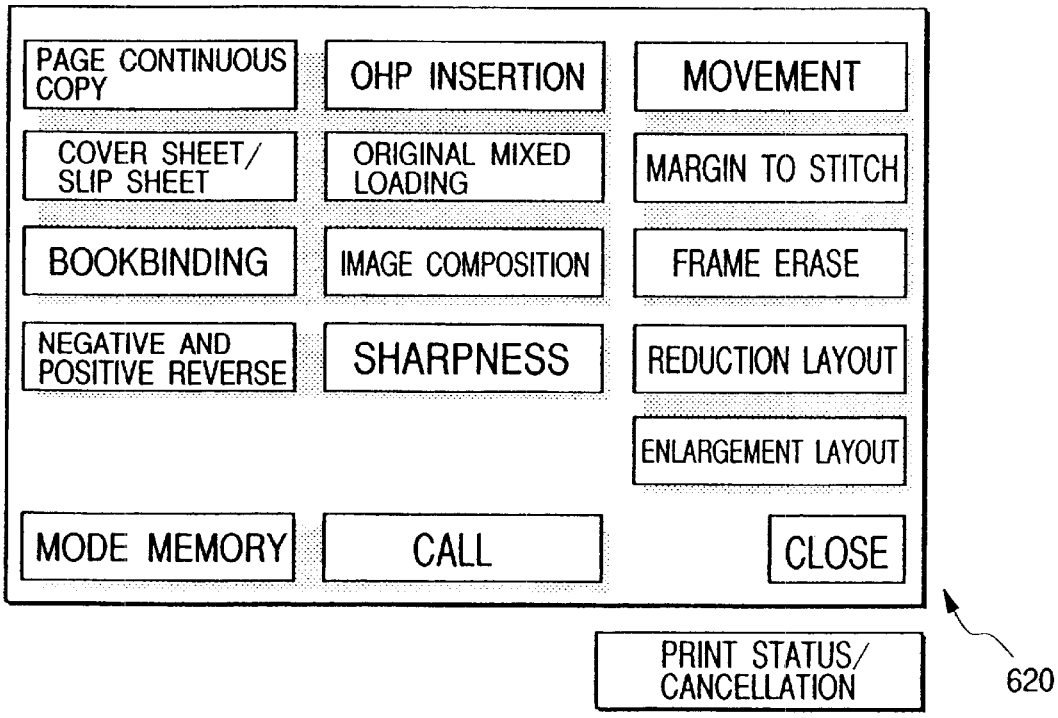
FIG. 8 is a plan view of a state of the display panel in which keypads for setting various application modes of the image forming apparatus are displayed.
Figure 9A:
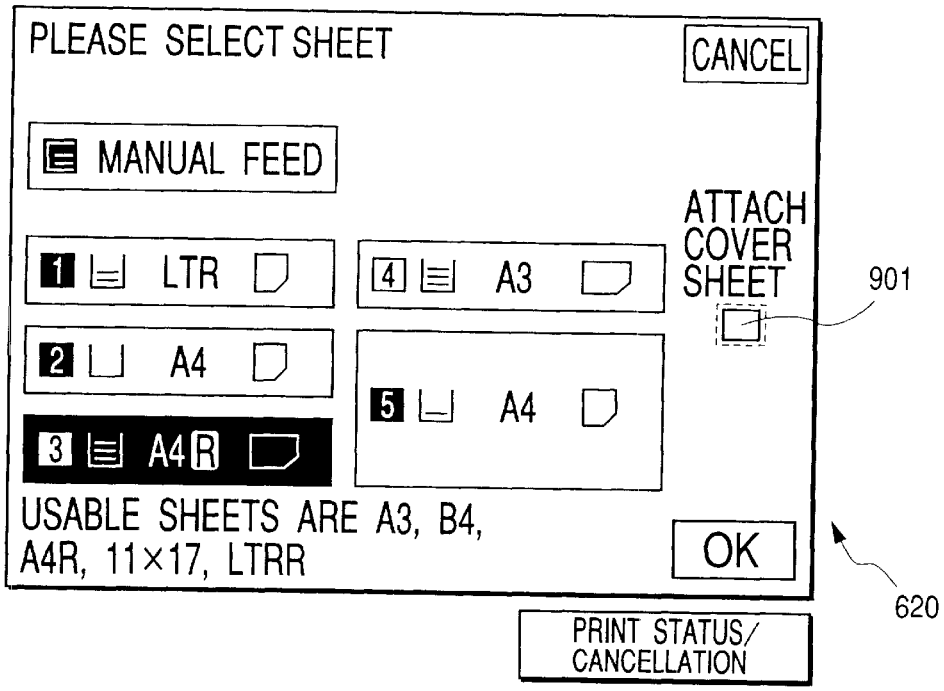
FIGS. 9A and 9B are plan views of states of the display panel relating to cover sheet setting in a bookbinding mode.
Figure 9B:
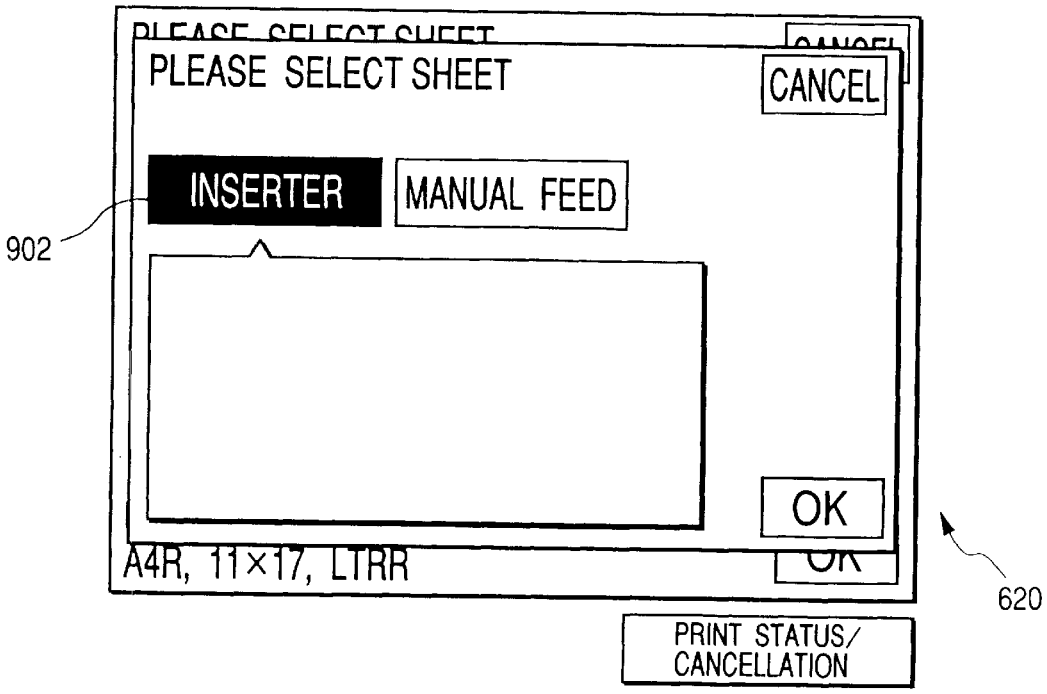

FIGS. 9A and 9B show some of screens for a setting in a bookbinding mode selected by the keypad shown in FIG. 8. It is possible to select a setting as to whether a cover sheet will be attached in a bookbinding mode in which a plurality of originals are reordered and laid out as double-page spreads. In the screen shown in FIG. 9A, a cover sheet keypad 901 can be operated to attach a cover sheet to a batch of outputs reordered and laid out for bookbinding.

FIG. 9B shows a screen for setting a cover sheet after the operation of the cover sheet keypad 901, through which a cover sheet feed stage can be set. In this screen, an inserter keypad 902 can be operated to set sheet insertion from the sheet inserting device 196.

Referring back to FIG. 6, a two-sided copying setting keypad 624 is a keypad for enabling setting of, for example, three two-sided copying modes: a "one-sided to two-sided copying mode" in which a two-sided output is formed from one-sided originals; a "two-sided to two-sided copying mode" in which a two-sided output is formed from a two-sided original; and a "two-sided to one-sided copying mode" in which two one-sided outputs are formed from a two-sided original. A discharge sheet treating setting keypad 625 is a keypad which, when depressed, enables setting of operation modes of the discharge sheet treating device 190 (see FIG. 1) and output sheet sort modes using the image memory.

Figure 10A:
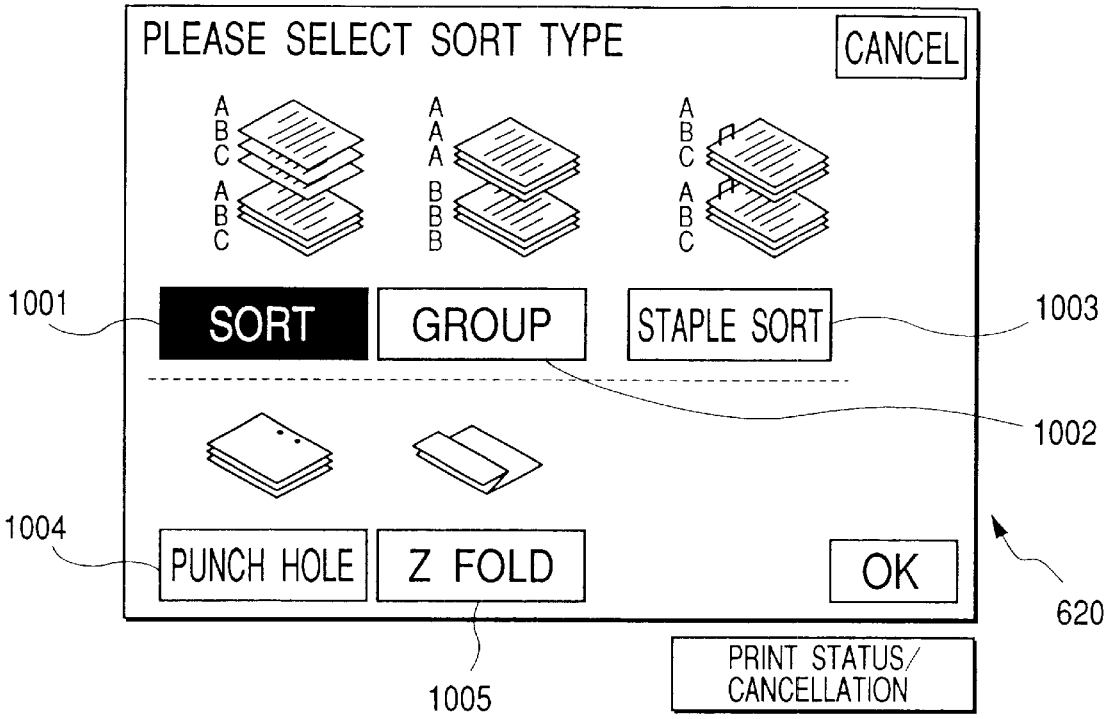
FIGS. 10A and 10B are plan views of states of the display panel in which setting screens for setting in a discharge sheet treating mode of the image forming apparatus are displayed.
Figure 10B:
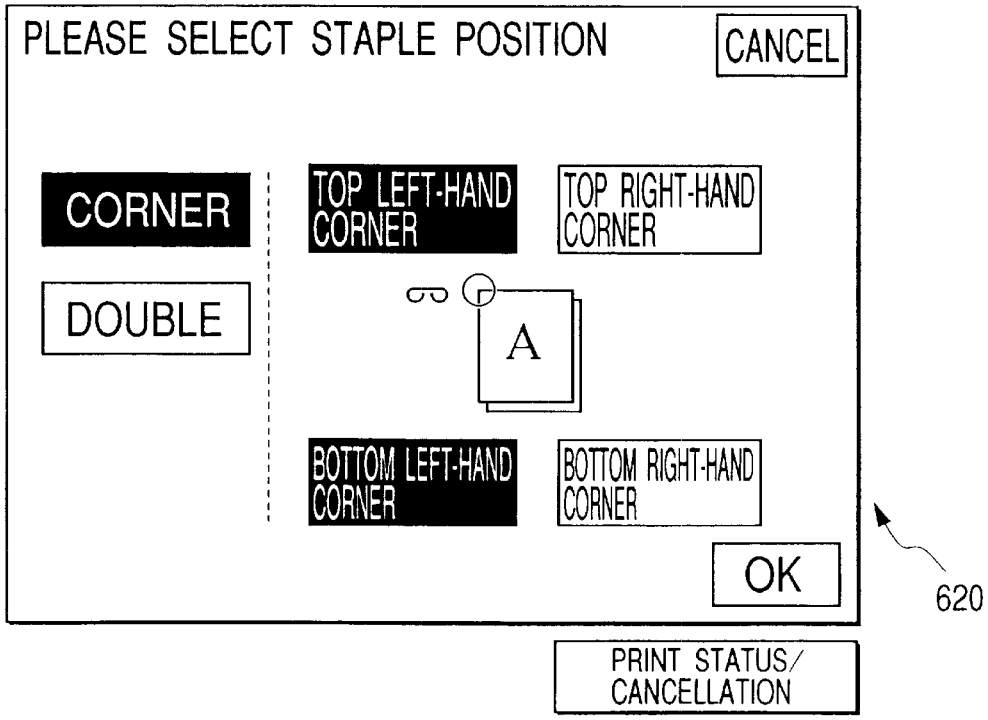

When the keypad 625 is depressed, screens for setting a treating operation mode in detail, such as those shown in FIGS. 10A and 10B, are displayed.

FIG. 10A shows a first displayed screen for setting an operation mode when the discharge sheet treating setting keypad 625 is depressed.

In this screen, each of a sort keypad 1001, a group mode keypad 1002, a staple sort keypad 1003, a punch keypad 1004, and Z-fold keypad 1005 can be depressed to designate the corresponding one of a sort mode in which output sheets are sorted with respect to each of copies, a group mode in which output sheets are sorted as the number of batches of sheets corresponding to the number of output copies, a staple sort mode in which output sheets are sorted and undergo a stitching process with the stapler 199, a punch mode in which holes are punched in trailing end portions of output sheets, and a Z-fold mode in which output sheets are Z-folded.

FIG. 10B shows a screen for setting a staple mode in detail, which is displayed when the staple sort keypad 1003 is depressed. This screen is for setting corner stapling (one-place stapling) in the staple sort mode. Through this screen, staple setting is possible in four places: a top right-hand corner, a bottom right-hand corner, a top left-hand corner, and a bottom left-hand corner. In this embodiment, to realize stapling in such four places, combinations of this side and that side positions of a stapling unit of the discharge sheet treating device 190 and the image rotating function of the image memory portion 3 are used.

A proof printing mode keypad (trial copying mode keypad) 632 is a keypad (selecting means) for setting a proof printing mode in which, in the case where the sort mode has been set by the discharge sheet treating setting keypad 625, when one copy is output in the process of outputting a plurality of copies, the printing operation is temporarily stopped to enable a user to confirm the result of copying and to select continuing copying if the result is good, or terminate copying if the result is not good.

Figure 11A:
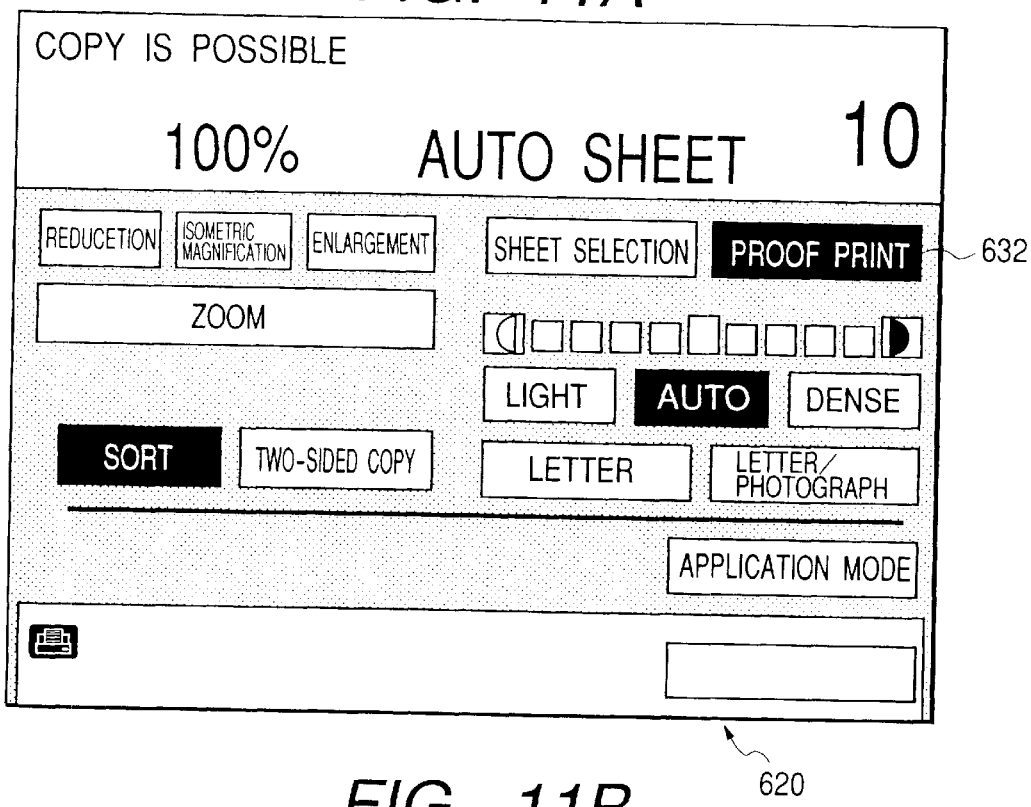
FIGS. 11A and 11B are plan views of states of the display panel at t time of a proof mode setting.
Figure 11B:
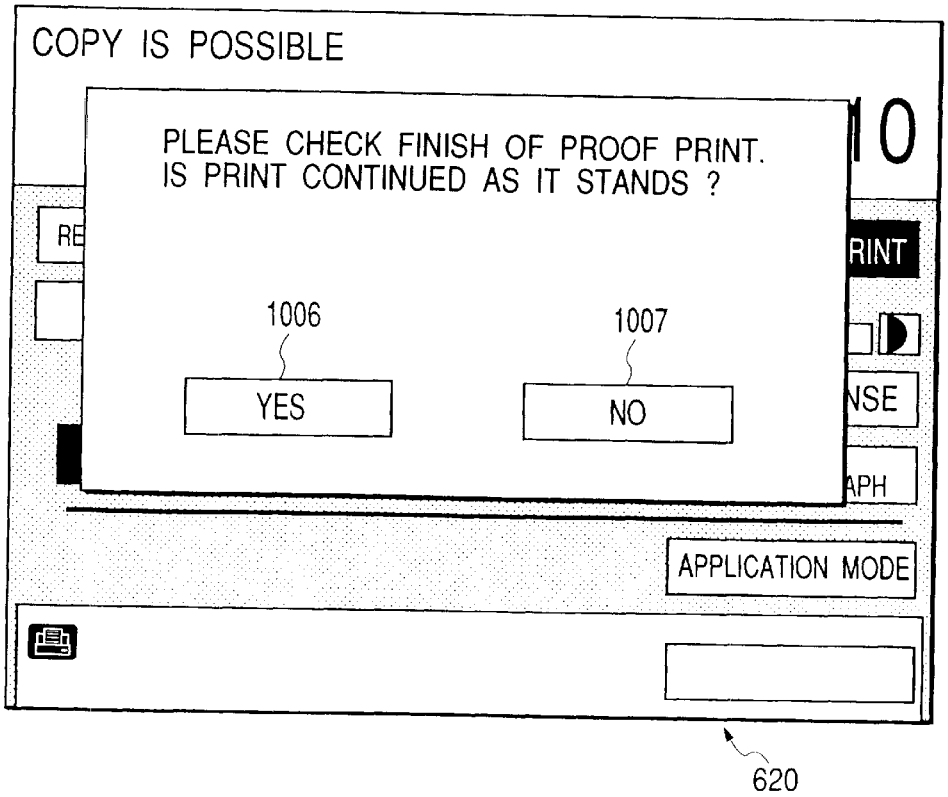

FIGS. 11A and 11B are diagrams showing a display of screens for setting in the proof mode.

FIG. 11A shows a state after setting the proof mode and before printing.

FIG. 11B shows a state where the printing operation is stopped after completion of outputting of one copy to enable a user to confirm the result and to select whether to continue printing or not. The user checks sheets on which images are formed, and operates a displayed button "YES" 1006 to make the image forming apparatus 99 continue printing if the images have been formed as desired, or stops printing by pressing a displayed button "NO" 1007 and resets image forming conditions if the images have not been formed as desired.

On the display panel, keypads are displayed in such a manner that some of the keypads are displayed in an ordinary manner while the other keypads are displayed in a dotted (shaded) state to indicate that they cannot be operated if the corresponding modes cannot be set.

In the example of the display shown in FIG. 6, the contents of a copying operation setting and the present operating state can be displayed in an upper section of the display panel 620. At the upper left corner of the screen, characters or the like are displayed for identification of the presently displayed screen as one of screens for functional modes described below. In the example shown in FIG. 6, a copy A setting screen is displayed. In the example shown in FIG. 6, the desired information is represented by letters. Alternatively, the information may be represented by symbols.

In a lower section of the display panel 620, the state of operation in other functional modes described below is displayed by being limited to one line. In the example shown in FIG. 6, a state where the operation of outputting a copy B to the printer portion is being performed is displayed. Keypads assignable by a user are provided at the side of the application mode keypad 626 in the display panel 620. That is, at most two keypads representing functions which can be set through the application mode setting image can be registered. If such application mode setting keypads are displayed at the position shown in FIG. 6, the registered modes can be set more easily.

In FIG. 6, keypads and LEDs for changing the display of the operating portion for setting respective functions in the copying operation and system operation using the image forming apparatus 99 are designated by the reference numerals 601 to 612. There keypads 601, 604, 607, and 610 indicate keypads for changing the respective functions. These keypads are formed by translucent buttons, and indication lamps such as LEDs (not shown) are provided in the keypads. When each of these keypads is depressed to select the corresponding operating screen, the lamp in the keypad is lighted. Lighting control is such that only the lamp in the keypad corresponding to the selected operating functional screen is lighted while the lamps in the other keypads are not lighted.

Green LEDs 603, 606, 609, and 612 are respectively placed on the right-hand sides of the respective keypads 601, 604, 607, and 610. The operating states of the corresponding functions are indicated by lighting control of these LEDs. For example, the LED 606 corresponding to copy B is controlled so as to be not lighted in a copy B standby state. When copy B is being output as in the example shown in FIG. 6, the LED 606 is controlled so as to be turned on and off. When images of copy B are stored in the hard disk 404 of the image memory portion 3 (see FIG. 4) and when the copy B printing operation is not performed, the LED is controlled so as to be continuously lighted. Similarly, the LED 609 for the facsimile, for example, is controlled so as to be turned on and off during each of the communicating operation, the printing operation and the reading operation and is controlled so as to be continuously lighted when a facsimile image is stored in the facsimile hard disk 502.

Red LEDs 602, 605, 608, and 611 are placed on the left-hand sides of the respective keypads 601, 604, 607, and 610. Each of these LEDs indicates, in a lighted state, occurrence of an abnormality of the corresponding function.

For example, the LED 605 for copy B is controlled so as to be turned on and off when an abnormality such as out-of-paper interruption or jamming occurs in copy B. In such an event, the copy B function keypad 604 is depressed to change the operating portion display to copy B, thereby displaying the state of copy B in the display panel and enabling a user to confirm details of the abnormal state. Each of these function change keypads can always be depressed to change the operating portion regardless of the state of the corresponding operation.

In the case where the copy A function and the copy B function can be switched as in this embodiment, each of the keypads other than the keypads in the display panel, i.e., the above-described stop keypad, start keypad, reset keypad, etc., is operated with respect to the function selected by the function change keypad 601 or 604. For example, even if the stop keypad is depressed when the copy A operation screen is being displayed as in the example shown in FIG. 6, the copying operation cannot be stopped with respect to the copy B output operation. To stop the copy B copying operation, the copy B function keypad 604 is depressed and the stop keypad 616 is thereafter depressed. Outputting copy B is thereby stopped.

Data set by the user setting keypad 618 includes data in each of the copy A and copy B screens selected for the operating portion, and the setting operation of the user setting keypad 618 can be performed independently with respect to these screens.

Figure 12:
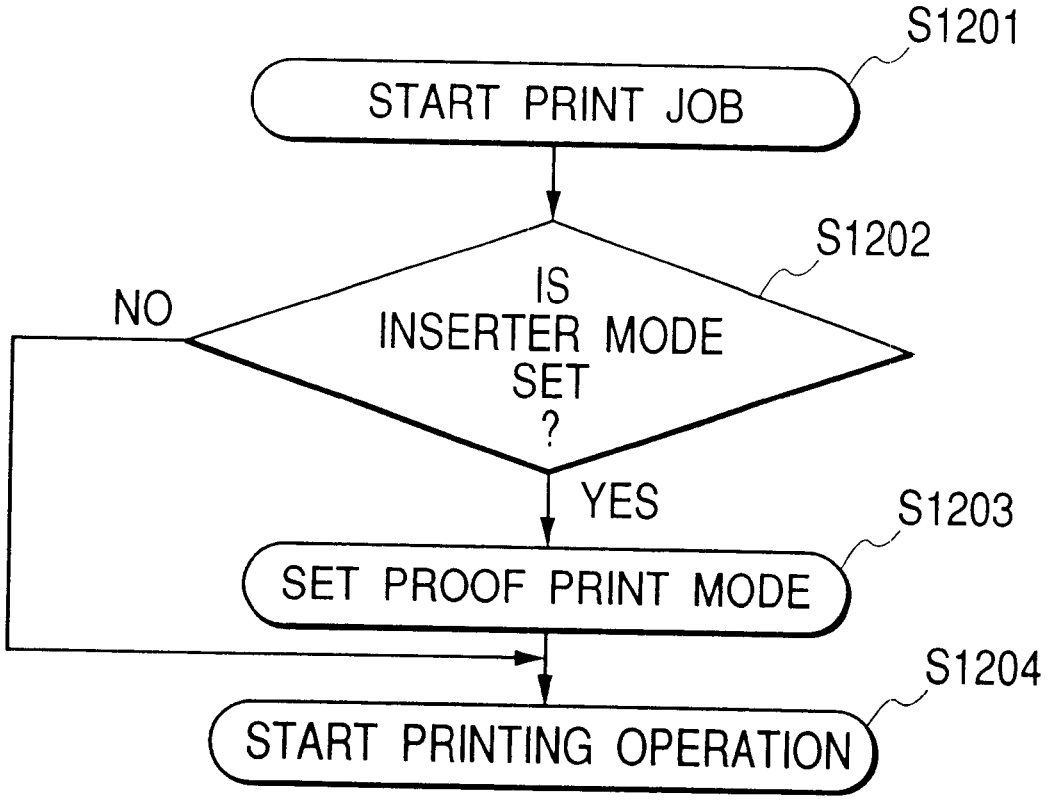
FIG. 12 is a flowchart of control in a first embodiment of the present invention.

FIG. 12 is a flowchart showing a control process in the first embodiment of the present invention.

When a need for staring a new print job (hereinafter referred to as "job A") arises in step (represented by "S" in FIG. 12) 1201, a determination is made in step 1202 as to whether a sheet inserting mode (hereinafter referred to as "inserter mode") has been set. This inserter mode is realized by the cover sheet feed cassette in the cover sheet/slip sheet mode or the bookbinding mode is set for inserter feed. Therefore, a determination is made as to whether there is a cover sheet setting in the cover sheet/slip sheet mode or the bookbinding mode and the cover sheet feed cassette corresponds to the inserter feed setting.

If it is determined in step 1202 that the inserter mode has been set, the proof print mode is automatically set in step 1203. Thereafter, the printing operation in accordance with the setting is started in step 1204.

If it is determined in step 1202 that the inserter mode has not been set, the print mode in accordance with the setting is started immediately in step 1204.

This is the control process in the fist embodiment of the present invention.

Figure 13:
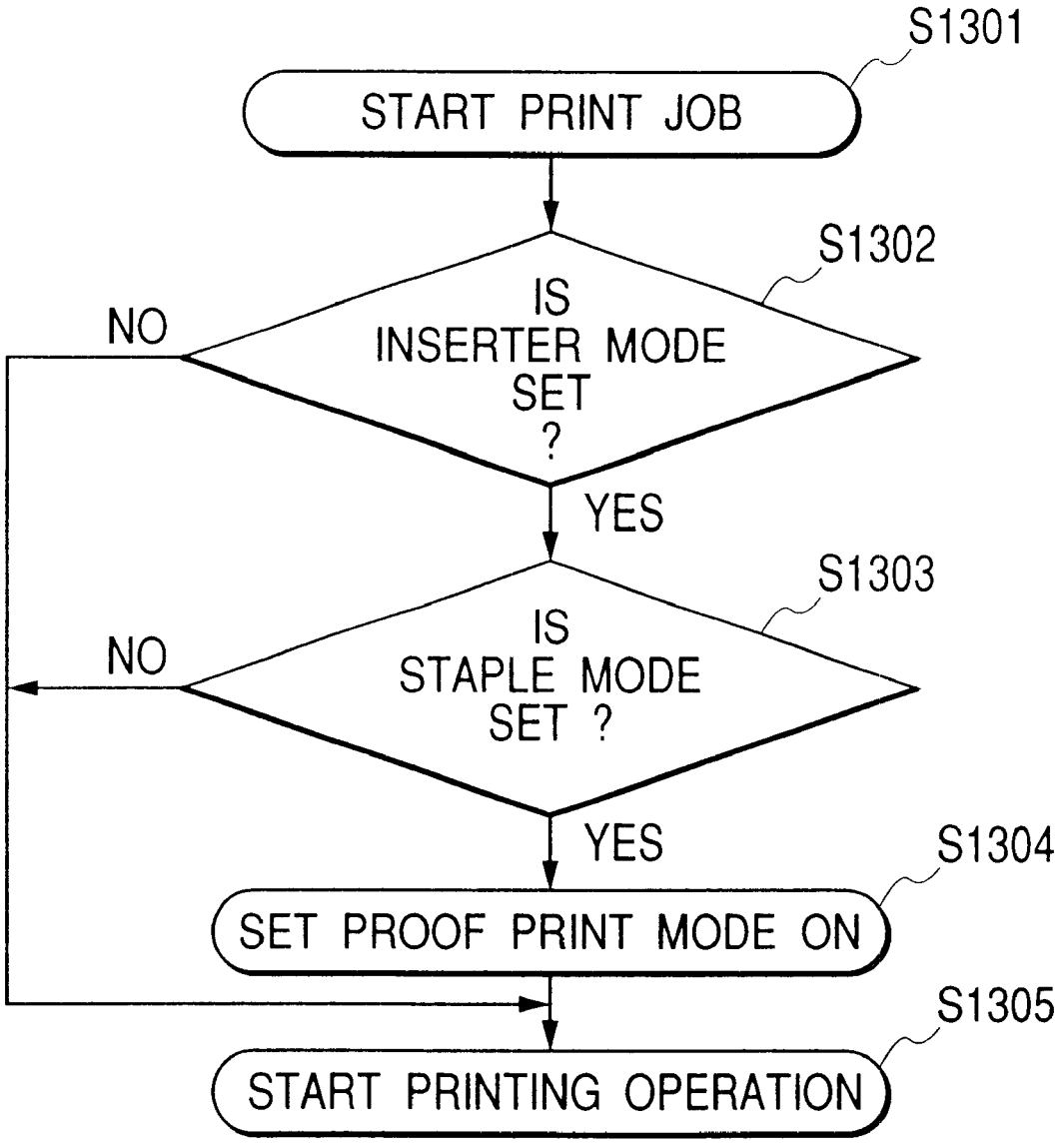
FIG. 13 is a flowchart of control in a second embodiment of the present invention.

FIG. 13 is a flowchart showing a control process in the second embodiment of the present invention.

When a need for staring a new print job (hereinafter referred to as "job A") arises in step (represented by "S" in FIG. 13) 1301, a determination is made in step 1302 as to whether a non-image-forming sheet inserting mode (hereinafter referred to as "inserter mode") has been set.

If it is determined in step 1302 that the inserter mode has been set, a determination is made in step 1303 as to whether the staple mode has been set simultaneously with the job A.

If it is determined in step 1302 that the inserter mode has not been set, the printing operation in accordance with the setting is immediately started in step 1305.

If it is determined in step 1303 that the staple mode has been set, it is then determined that there is a need for a user to confirm whether the direction in which a non-image-forming sheet is set has been correctly set. Then, in step 1304, the proof printing mode is automatically set. Thereafter, the printing operation in accordance with the setting is started in step 1305. If it is determined in step 1303 that the staple mode has not been set, the printing operation in accordance with the setting is immediately started in step 1305.

This is the control process in the second embodiment of the present invention.

In this embodiment, the same process can also be performed even if a hole cutting operation is performed instead of stapling in step 1303.

Figure 14:
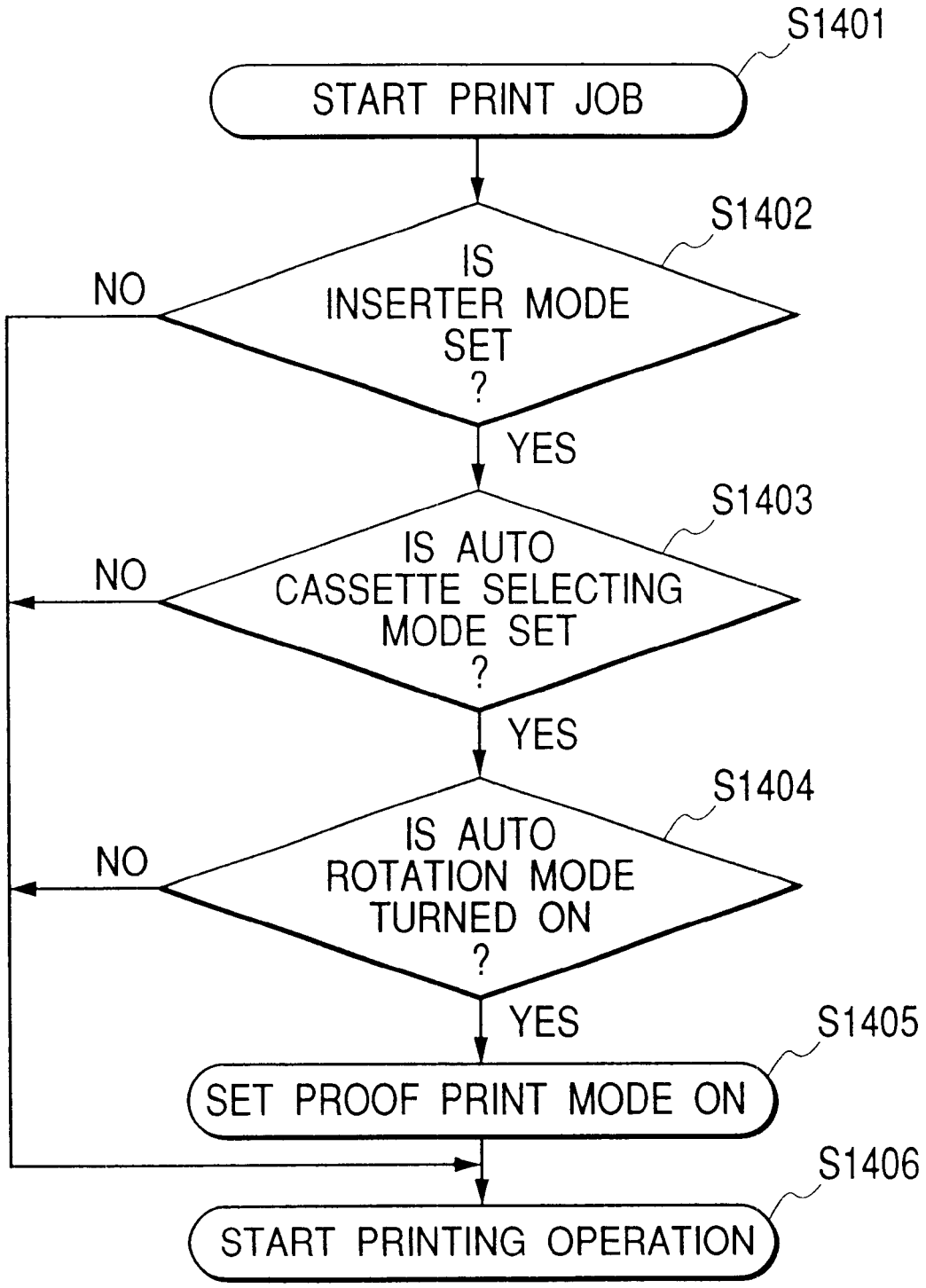
FIG. 14 is a flowchart of control in a third embodiment of the present invention.

FIG. 14 is a flowchart showing a control process in the third embodiment of the present invention.

When a need for staring a new print job (hereinafter referred to as "job A") arises in step (represented by "S" in FIG. 14) 1401, a determination is made in step 1402 as to whether a sheet inserting mode (hereinafter referred to as "inserter mode") has been set.

If it is determined in step 1402 that the inserter mode has been set, a determination is made in step 1403 as to whether the automatic cassette selecting mode has been set simultaneously with the job A.

If it is determined in step 1402 that the inserter mode has not been set, the printing operation in accordance with the setting is immediately started in step 1406.

If it is determined in step 1403 that the automatic cassette selecting mode has been set, a determination is made in step 1404 as to whether the automatic rotation setting is on.

If it is determined in step 1403 that the automatic cassette selecting mode has not been set, the printing operation in accordance with the setting is started in step 1406.

If it is determined in step 1404 that the automatic rotation setting is on, it is then determined that there is a need for a user to confirm whether the direction in which a sheet is set has been correctly set. Then, in step 1405, the proof printing mode is automatically set. Thereafter, the printing operation in accordance with the setting is started in step 1406.

If it is determined in step 1404 that the automatic rotation setting is not on, the printing operation in accordance with the setting is started in step 1406.

This is the control process in the third embodiment of the present invention.

If in this embodiment the automatic cassette selecting mode in step 1403 is not provided, automatic rotation is performed with respect to the sheet size in the cassette previously designated, for example. In such a case, if the rotated image does not extend beyond any side of the sheet, the proof printing mode is set. The process may be such that if it is determined that the rotated image extends beyond one side of the sheet, the rotating operation is not performed and the operation in the proof printing mode may not be performed.

When discharge of a first copy consisting of a batch of sheets is completed, the image forming portion 126 temporarily stops the image formation, although this is not shown in the above-described flowcharts. However, at the time of stoppage, the position at which the subsequent sheet is located varies depending upon the sheet transport interval. That is, if the sheet transport interval is short, there is a possibility of the sheet having an image already formed by the image forming portion 126 and stopping on the upstream side of the discharge roller 161 when the image forming portion 126 stops operating. Conversely, if the sheet transport interval is long, there is a possibility of the sheet stopping on the upstream side of the image forming portion 126 before reaching the image forming portion 126.

According to the present invention, as described above, when the operation in a predetermined sheet treating mode is executed, the proof printing mode is automatically set to enable a user to easily confirm the printing result by checking a proof print, thus preventing occurrence of a large amount of misprints due to omission of setting the proof mode.

What is claimed is:

1. An image forming apparatus comprising:

image forming means for forming an image on a sheet;

discharging means for discharging the sheet on which the image has been formed, onto a discharge tray; and mode control means for automatically setting a proof printing mode when execution of a predetermined process mode is selected, wherein, in a process of forming an image on sheets to form a plurality of copies of sheets, image formation by said image forming means is temporarily stopped in said proof printing mode, when discharge of the sheets having the image formed thereon to form a first copy of sheets is completed, so as to enable a user to confirm a result of copying.

2. An image forming apparatus according to claim 1, wherein said predetermined process mode comprises a sheet insertion mode in which a sheet inserting device inserts an insert sheet among the sheets on which images have been formed and which are to be discharged.

3. An image forming apparatus according to claim 2, wherein said sheet inserting device inserts the insert sheet, downstream of said image forming means in the sheet transport direction, among the sheets on which the images have been formed and which are being transported to be discharged.

4. An image forming apparatus according to claim 1, wherein said predetermined process mode comprises:

a sheet insertion mode in which a sheet inserting device inserts an insert sheet among the sheets on which images have been formed and which are to be discharged; and a sheet treating mode in which a copy of sheets including the sheets having the images formed thereon and the insert sheet are subjected to a sheet treatment by a sheet treating device.

5. An image forming apparatus according to claim 4, wherein said sheet treating device comprises a sheet punching device.

6. An image forming apparatus according to claim 4, wherein said sheet treating device comprises a sheet stitching device.

7. An image forming apparatus according to claim 1, wherein said predetermined process mode comprises:

a sheet insertion mode in which a sheet inserting device inserts an insert sheet into the sheets on which images have been formed and which are to be discharged; and an image rotation mode in which an orientation of the image in accordance with the image information is rotated by image rotation means according to an orientation of the sheet before an image formation.

8. An image forming apparatus according to claim 7, wherein said image rotation means compares an original size detected by original size detection means and a sheet size detected by sheet size detection means, and rotates the orientation of the original image to coincide with the orientation of the sheet if the orientation of the original and the orientation of the sheet are different from each other, and wherein said mode control means executes the image rotation mode and sets the proof printing mode if it determines that the image can be formed within an area of the sheet when the orientation of the image is rotated so as to coincide with the orientation of the sheet by said image rotation means.

9. An image forming apparatus according to claim 8, wherein said mode control means cancels the image rotation mode and does not set the proof printing mode, if it determines that the image cannot be formed within the area of the sheet when the orientation of the image is rotated so as to coincide with the orientation of the sheet by said image rotation means.

10. An image forming apparatus according to any one of claims 1, 2, 4 or 7, wherein, if said predetermined process mode is not selected, the image formation for obtaining all the copies of the sheets is continuously performed without being stopped.

11. An image forming apparatus comprising:

image forming means for forming an image on a sheet;

discharging means for discharging the sheet on which the image has been formed, onto a discharge tray;

mode control mean for automatically setting a proof printing mode when execution of a predetermined process mode is selected;

wherein, in a process of forming an image on sheets to form a plurality of copies of sheets, image formation by said image formation means is temporarily stopped in said proof printing mode, when discharge of the sheets having the image formed thereon to form a first copy of sheets is completed, so as to enable a user to confirm a result of copying; and selection means for enabling selection of restarting the image formation or canceling the image formation in a state that the image formation is temporarily stopped in said proof printing mode after the discharge of the sheets having the image formed thereon to form the first copy of sheets is completed.

12. An image forming apparatus according to claim 11, wherein said predetermined process mode comprises a sheet insertion mode in which a sheet inserting device inserts an insert sheet among the sheets on which images have been formed and which are to be discharged.

13. An image forming apparatus according to claim 11, wherein said predetermined process mode comprises:

a sheet insertion mode in which a sheet inserting device inserts an insert sheet among the sheets on which images have been formed and which are to be discharged; and a sheet treating mode in which a copy of sheets including the sheets having the images formed thereon and the insert sheet is subjected to a sheet treatment by a sheet treating device.

14. An image forming apparatus according to claim 11, wherein said predetermined process mode comprises:

a sheet insertion mode in which a sheet inserting device inserts an insert sheet among the sheets on which images have been formed and which are to be discharged; and an image rotation mode in which an orientation of the image in accordance with the image information is rotated by image rotation means according to an orientation of the sheet before an image formation.

15. An image forming apparatus according to any one of claims 11, 12, 13 and 14, wherein, after the image formation has been restarted, the image formation is continuously performed to obtain a remainder of all the copies of sheets.

16. An image forming apparatus according to any one of claims 11, 12, 13 or 14, further comprising notification means for notifying that the image formation is temporarily stopped in the proof printing mode.

* * * * *

UNITED STATES PATENT AND TRADEMARK OFFICE

CERTIFICATE OF CORRECTION

PATENT NO. : 6,453,133 B1
DATED : September 17, 2002
INVENTOR(S) : Yoshihito Osari et al.

It is certified that error appears in the above-identified patent and that said Letters Patent is hereby corrected as shown below:

Title page, Item [54] and Column 1, line 1,
Title, "PROCESS" should read -- PROCESSING --.

Column 1,
Line 43, "according" should read -- according to --.

Column 2,
Line 57, "t" should read -- the --.

Column 12,
Line 45, "fist" should read -- first --.

Column 15,
Line 20, "mean" should read -- means --; and
Line 22, "selected;" should read -- selected, --.

Signed and Sealed this

Twenty-fifth Day of March, 2003

JAMES E. ROGAN
*Director of the United States Patent and Trademark Office*